US005595343A

United States Patent [19]

Marhelko

[11] Patent Number: 5,595,343

[45] Date of Patent: Jan. 21, 1997

[54] SNOW COLORING DEVICE

[76] Inventor: George Marhelko, Box 614, Nuremberg, Pa. 18241

[21] Appl. No.: 517,369

[22] Filed: Aug. 21, 1995

[51] Int. Cl.[6] ..... B05B 7/24

[52] U.S. Cl. ..... 239/154; 239/304; 239/337

[58] Field of Search ..... 239/366, 368, 239/304, 340, 341, 152–154, 337

[56] References Cited

U.S. PATENT DOCUMENTS

| | | | |
|---|---|---|---|
| 567,452 | 9/1896 | Cleaver | 239/368 |
| 888,693 | 5/1908 | Bustinza | 239/152 X |
| 4,546,922 | 10/1985 | Thometz | 239/153 X |
| 5,086,978 | 2/1992 | Fertig | 239/340 X |
| 5,094,400 | 3/1992 | Ching | 239/341 |

FOREIGN PATENT DOCUMENTS

| | | | |
|---|---|---|---|
| 2177620 | 1/1987 | United Kingdom | 239/340 |
| 2244221 | 11/1991 | United Kingdom | 239/154 |

*Primary Examiner*—Kevin Weldon

[57] ABSTRACT

A snow coloring device comprised of a cylindrical pressure container having a pump therein. The container has valve stems extending outwardly of a top end thereof and extending outwardly of a side wall thereof. A pair of hoses are coupled with the valve stems of the cylindrical pressure container. An elongated housing has a first end adapted to coupled with an end portion of the hose extending from the valve stem in the top end of the cylindrical pressure container. A second end has a spray nozzle secured thereto. The elongated housing has a transport tube extending from the end portion of the hose to the spray nozzle. A paint container is integral with the upper portion of the elongated housing downwardly of the trigger mechanism. The paint container has a valve stem secured thereto coupled with the air hose from the side wall of the cylindrical pressure container. The paint container is adapted to hold coloring dye therein. The paint container has a vertical tube extending downwardly therefrom to couple with the transport tube of the elongated housing.

1 Claim, 4 Drawing Sheets

SNOW COLORING DEVICE

BACKGROUND OF THE INVENTION

1. Field of the Invention

The present invention relates to a snow coloring device and more particularly pertains to allowing children or adults to paint snow in a variety of colors with a snow coloring device.

2. Description of the Prior Art

The use of squirt guns is known in the prior art. More specifically, squirt guns heretofore devised and utilized for the purpose of projecting fluids such as streams of water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,079,048 to Anitole discloses a camouflage augmentation device and method.

U.S. Pat. No. 5,165,966 to Adams discloses a process for painting snow.

U.S. Pat. No. 4,364,994 to Fogelberg discloses a process and composition for minimizing accumulation of moisture on a cold surface exposed to humid conditions and product obtained thereby.

U.S. Pat. No. 3,841,019 to Lorenzo discloses a snowman feature and accessory system.

U.S. Pat. No. 4,591,071 to Johnson discloses a squirt gun.

U.S. Pat. No. 5,219,096 to Wing discloses a leakproof self defense liquid squirt gun.

While these devices fulfill their respective, particular objective and requirements, the aforementioned patents do not describe a snow coloring device for allowing children or adults to paint snow in a variety of colors.

In this respect, the snow coloring device according to the present invention substantially departs from the conventional concepts and designs of the prior art, and in doing so provides an apparatus primarily developed for the purpose of allowing children or adults to paint snow in a variety of colors.

Therefore, it can be appreciated that there exists a continuing need for new and improved snow coloring device which can be used for allowing children or adults to paint snow in a variety of colors. In this regard, the present invention substantially fulfills this need.

SUMMARY OF THE INVENTION

In the view of the foregoing disadvantages inherent in the known types of squirt guns now present in the prior art, the present invention provides an improved snow coloring device. As such, the general purpose of the present invention, which will be described subsequently in greater detail, is to provide a new and improved snow coloring device and method which has all the advantages of the prior art and none of the disadvantages.

To attain this, the present invention essentially comprises a harness having two shoulder straps and a waist strap. The two shoulder straps have end portions secured to the waist strap. The waist strap is adjustably coupled around a waist of a user with the shoulder straps securing over shoulders of the user. The device contains a cylindrical pressure container having a top end, a bottom end, and a surrounding side wall therebetween. The cylindrical pressure container has an opening formed through the top end. The opening receives a pump therein. The container has valve stems extending outwardly of the top end thereof and extending outwardly of the side wall thereof. A pair of hoses are coupled with the valve stems of the cylindrical pressure container. A shield portion is secured between the two shoulder straps of the harness for optional coupling with the cylindrical pressure container. The device contains an elongated housing having a first end and a second end. The first end is adapted to coupled with an end portion of the hose extending from the valve stem in the top end of the cylindrical pressure container. The second end has a spray nozzle secured thereto. The elongated housing has a transport tube extending from the end portion of the hose to the spray nozzle. The elongated housing has a spring biased trigger mechanism secured to an upper portion thereof whereby depressing of the trigger mechanism will allow flow of air from the first end freely to the second end and release of the trigger mechanism will prevent the flow of air from the first end to the second end. The elongated housing has a latch pivotally secured thereto. The latch is adapted to engage the trigger mechanism when it is depressed thereby locking it in to allow the free flow of air. A paint container is integral with the upper portion of the elongated housing downwardly of the trigger mechanism. The paint container has an open top. The open top has a lid hingedly secured thereto. The open top had a valve stem secured thereto coupled with the air hose from the side wall of the cylindrical pressure container. The open top has a plurality of compartments formed therein. Each of the compartments is adapted to hold coloring dye therein. Each of the compartments has a vertical tube extending downwardly therefrom to couple with the transport tube of the elongated housing. Each vertical tube has a needle valve extending outwardly therefrom. Each of the needle valves has a first position to allow coloring dye into the transport tube and a second position to prevent the coloring dye from entering into the transport tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved snow coloring device which has all the advantages of the prior art squirt guns and none of the disadvantages.

It is another object of the present invention to provide a new and improved snow coloring device which may be easily and efficiently manufactured and marketed.

It is a further object of the present invention to provide a new and improved snow coloring device which is of durable and reliable construction.

An even further object of the present invention is to provide a new and improved snow coloring device which is susceptible of a low cost of manufacture with regard to both materials and labor, and which accordingly is then susceptible of low prices of sale to the consuming public, thereby making such a snow coloring device economically available to the buying public.

Still yet another object of the present invention is to provide a new and improved snow coloring device which provides in the apparatuses and methods of the prior art some of the advantages thereof, while simultaneously overcoming some of the disadvantages normally associated therewith.

Even still another object of the present invention is to provide a new and improved snow coloring device for allowing children or adults to paint snow in a variety of colors.

Lastly, it is an object of the present invention to provide a cylindrical pressure container having a pump therein. The container has valve stems extending outwardly of a top end thereof and extending outwardly of a side wall thereof. A pair of hoses are coupled with the valve stems of the cylindrical pressure container. An elongated housing has a first end adapted to coupled with an end portion of the hose extending from the valve stem in the top end of the cylindrical pressure container. A second end has a spray nozzle secured thereto. The elongated housing has a transport tube extending from the end portion of the hose to the spray nozzle. A paint container is integral with the upper portion of the elongated housing downwardly of the trigger mechanism. The paint container has a valve stem secured thereto coupled with the air hose from the side wall of the cylindrical pressure container. The paint container is adapted to hold coloring dye therein. The paint container has a vertical tube extending downwardly therefrom to couple with the transport tube of the elongated housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
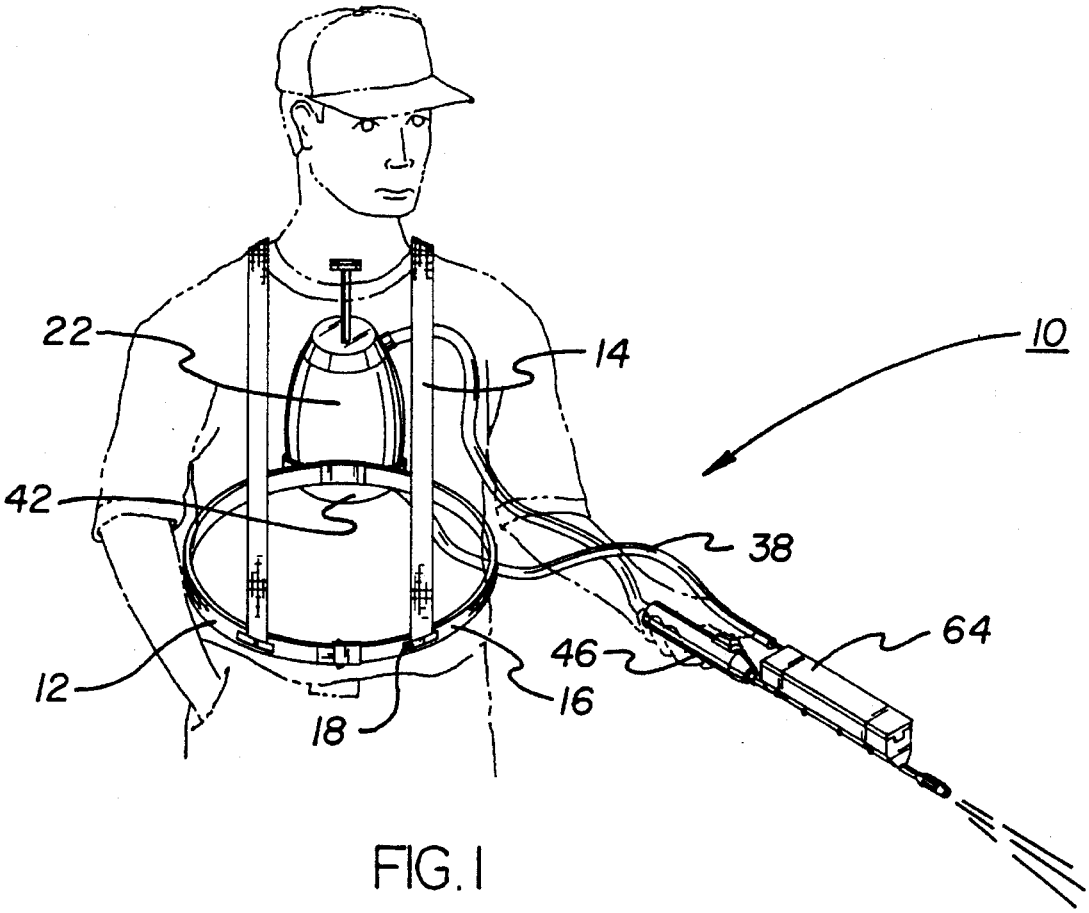
FIG. 1 is a perspective view of the preferred embodiment of the snow coloring device constructed in accordance with the principles of the present invention.
Figure 2:
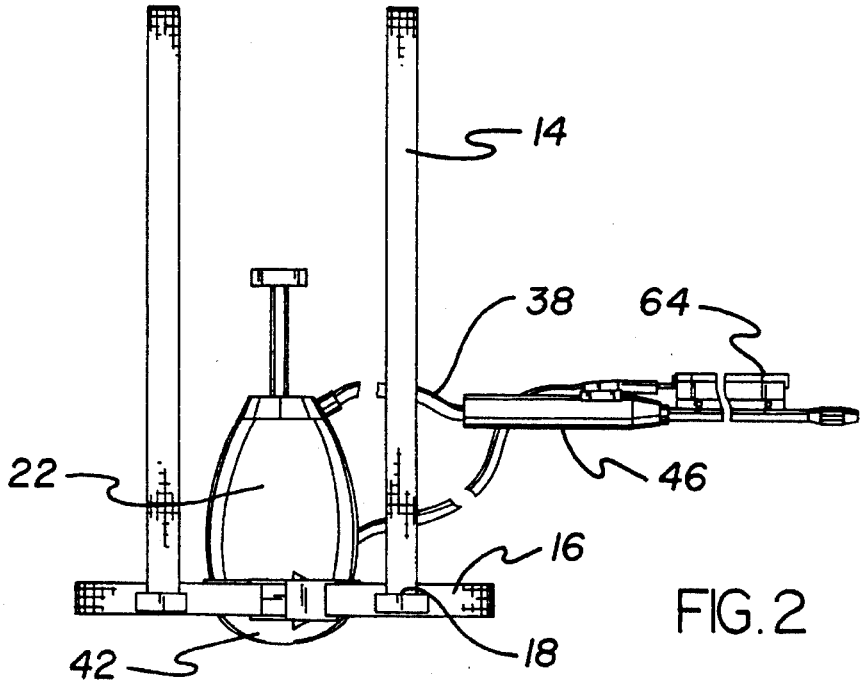
FIG. 2 is a front elevation view of the present invention.
Figure 3:
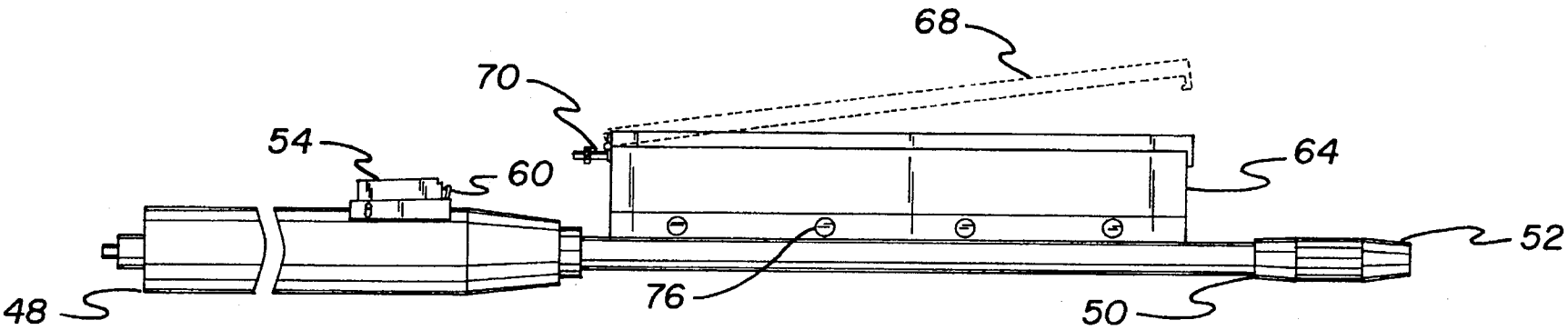
FIG. 3 is a side elevation view of the spray gun of the present invention.
Figure 4:
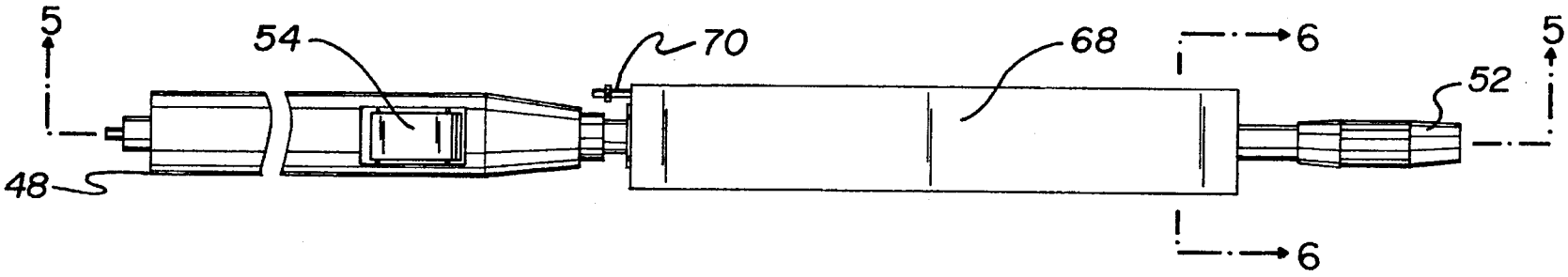
FIG. 4 is a plan view of the spray gun of the present invention.
Figure 5:
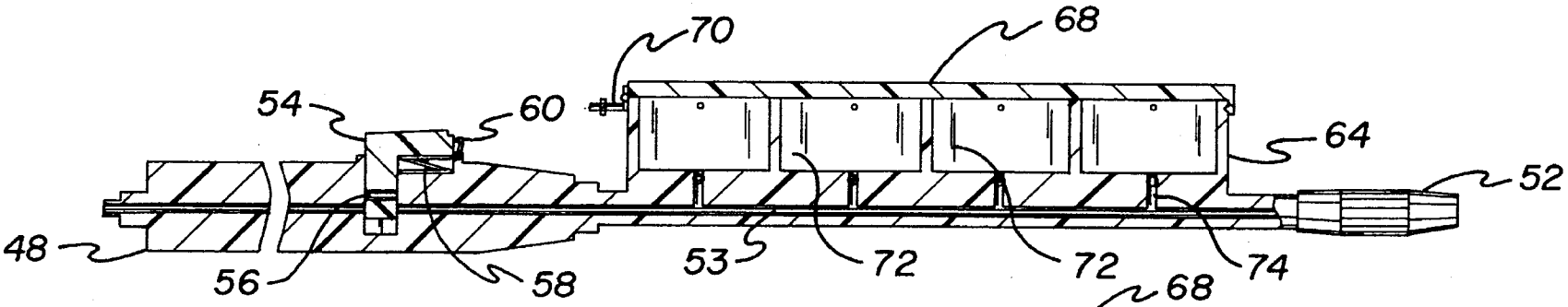
FIG. 5 is a cross-sectional view as taken along line 5—5 of FIG. 4.
Figure 6:
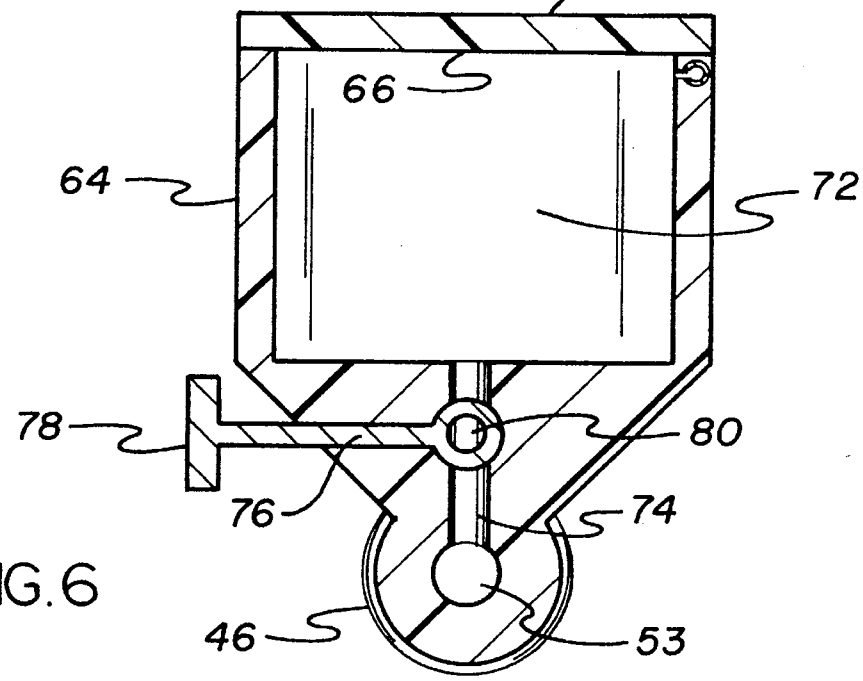
FIG. 6 is a cross-sectional view as taken along line 6—6 of FIG. 3.
Figure 7:
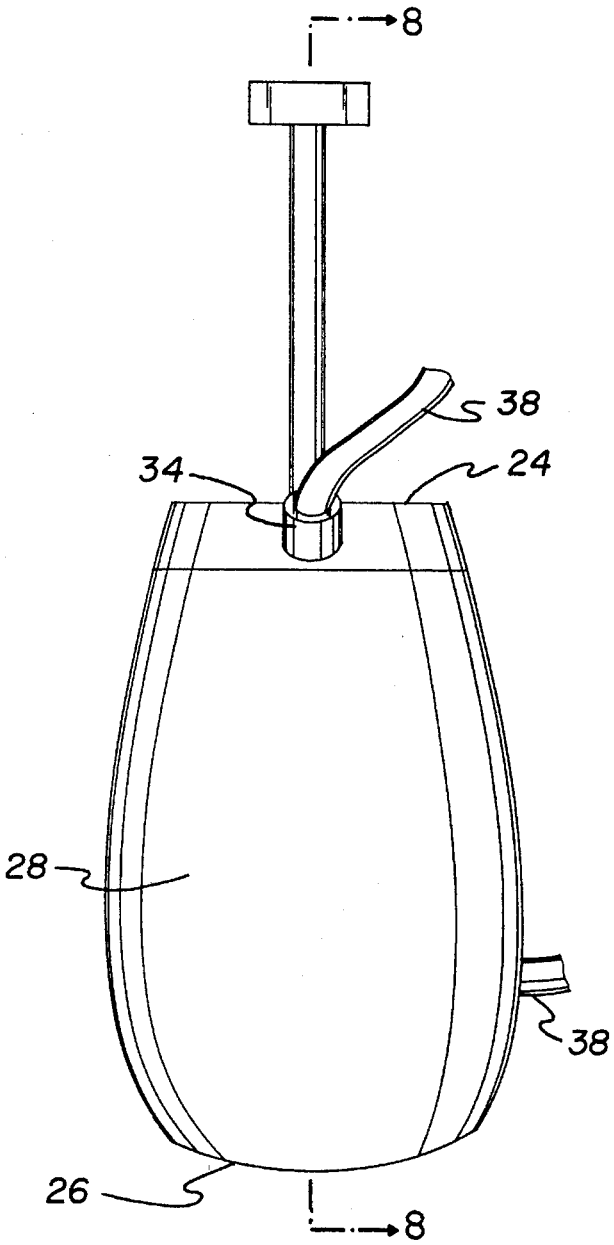
FIG. 7 is front view of the pressure container of the present invention.
Figure 8:
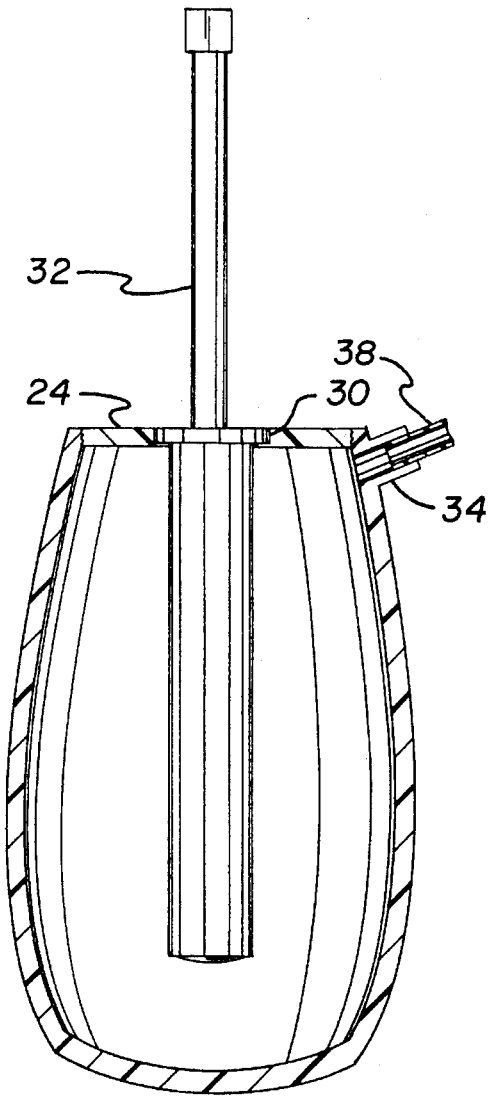
FIG. 8 is a cross-sectional view as taken along line 8—8 of FIG. 7. The same reference numerals refer to the same parts through the various Figures.

With reference now to the drawings, and in particular, to FIGS. 1–8 thereof, the preferred embodiment of the new and improved snow coloring device embodying the principles and concepts of the present invention and generally designated by the reference number 10 will be described.

Specifically, it will be noted in the various Figures that the device relates to a new and improved snow coloring device for allowing children or adults to paint snow in a variety of colors. In its broadest context, the device consists of a harness, a cylindrical pressure container, a pair of hoses, a shield portion, an elongated housing, and a paint container.

The device 10 contains a harness 12 having two shoulder straps 14 and a waist strap 16. The two shoulder straps 14 have end portions 18 secured to the waist strap 16. The waist strap 16 is adjustably coupled around a waist of a user with the shoulder straps 14 securing over shoulders of the user. The waist strap 16 and the shoulder straps 14 can be adjusted to conform to different sized users. The harness 12 allows the user to easily transport the device 10 while using it. Although the harness 12 is not the most important component of the device 10, it is a desired accessory.

The device contains a cylindrical pressure container 22 having a top end 24, a bottom end 26, and a surrounding side wall 28 therebetween. The cylindrical pressure container 22 has an opening 30 formed through the top end 24. The opening 30 receives a pump 32 therein. The container 22 has valve stems 34 extending outwardly of the top end 24 thereof and extending outwardly of the side wall 28 thereof. A user simply pulls up and down on the pump 32 to fill the container with air to be released through the valve stems 34. The container 22 is preferably constructed of a rigid plastic material that is both lightweight and durable.

A pair of hoses 38 are coupled with the valve stems 34 of the cylindrical pressure container 22. The pair of hoses 38 serve to transport the pressurized air from the cylindrical pressure container 22 to the elongated housing. The hoses 38 are preferably constructed on a flexible plastic material or a synthetic rubber.

A shield portion 42 is secured between the two shoulder straps 14 of the harness 12 for optional coupling with the cylindrical pressure container 22. The shield portion 42 is preferably located on a front portion of the harness 12 so that it parallels a user's chest thereby allowing the container 22 is accessible for the user to pump up the pressurized air from the container 22.

The device 10 contains an elongated housing 46 having a first end 48 and a second end 50. The first end 48 is adapted to coupled with an end portion of the hose 38 extending from the valve stem 34 in the top end 24 of the cylindrical pressure container 22. The second end 50 has a spray nozzle 52 secured thereto. The elongated housing 46 has a transport tube 53 extending from the end portion of the hose 38 to the spray nozzle 52. The elongated housing 46 has a spring biased trigger mechanism 54 secured to an upper portion thereof whereby depressing of the trigger mechanism 54 will allow flow of air from the first end 48 freely to the second end 50 via the transport tube 53 and release of the trigger mechanism 54 will prevent the flow of air from the first end 48 to the second end 50. The trigger mechanism 54 is generally L-shaped with a channel 56 formed in its lower end. The channel 56, when positioned properly, allows the air to flow through the transport tube 53 from the first end 48 to the second end 50. A spring 58 is positioned on an outer portion of the elongated housing 46. The spring 58 serves to bias the trigger mechanism 54 upwardly so that the channel 56 is not in cooperation with the transport tube 53 thus preventing the flow of air therethrough. The elongated housing 46 has a latch 60 pivotally secured thereto. The latch 60 is adapted to engage the trigger mechanism 54 when it is depressed thereby locking it in to allow the free flow of air.

A paint container 64 is integral with the upper portion of the elongated housing 46 downwardly of the trigger mechanism 54. The paint container 64 has an open top 66. The open top 66 has a lid 68 hingedly secured thereto. The open top 66 has a valve stem 70 secured thereto and coupled with the air hose 38 from the side wall 28 of the cylindrical pressure container 22. The open top 66 has a plurality of compartments 72 formed therein. Each of the compartments 72 is adapted to hold coloring dye therein. Each of the compartments 72 has a vertical tube 74 extending downwardly therefrom to couple with the transport tube 53 of the elongated housing 46. Each vertical tube 74 has a needle valve 76 extending outwardly therefrom. Each of the needle valves 76 has a first position to allow coloring dye into the transport tube 53 and a second position to prevent the coloring dye from entering into the transport tube 53. The needle valve 76 has a handle portion 78 accessible by a user to rotate. The needle valve 76 has an end portion with an aperture 80 formed therethrough. The aperture 80 corresponds in size with the diameter of the vertical tube 74 whereby the user can rotate the needle valve 76 to allow the colored dye to travel through the vertical tube 74 and into the transport tube 53.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A snow coloring device for allowing children or adults to paint snow in a variety of colors comprising, in combination:

a harness having two shoulder straps and a waist strap, the two shoulder straps having end portions secured to the waist strap, the waist strap being adjustably coupled around a waist of a user with the shoulder straps securing over shoulders of the user;

a cylindrical pressure container having a top end, a bottom end, and a surrounding side wall therebetween, the cylindrical pressure container having an opening formed through the top end, the opening receiving a pump therein, the container having nipples extending outwardly of the top end thereof and extending outwardly of the side wall thereof;

a pair of hoses coupled with the nipples of the cylindrical pressure container;

a shield portion secured between the two shoulder straps of the harness for optional coupling with the cylindrical pressure container;

an elongated housing having a first end and a second end, the first end being adapted to be coupled with an end portion of the hose extending from the nipple in the top end of the cylindrical pressure container, the second end having a spray nozzle secured thereto, the elongated housing having a transport tube extending from the end portion of the hose to the spray nozzle, the elongated housing having a spring biased trigger mechanism secured to an upper portion thereof whereby depressing of the trigger mechanism will allow flow of air from the first end freely to the second end and release of the trigger mechanism will prevent the flow of air from the first end to the second end, the elongated housing having a latch pivotally secured thereto, the latch adapted to engage the trigger mechanism when it is depressed thereby locking it in to allow the free flow of air;

a paint container integral with the upper portion of the elongated housing adjacent to the trigger mechanism, the paint container having an open top, the open top having a lid hingedly secured thereto, the open top having a nipple secured thereto coupled with the air hose from the side wall of the cylindrical pressure container, the open top having a plurality of compartments formed therein, each of the compartments being adapted to hold coloring dye therein, each of the compartments having a vertical conduit extending downwardly therefrom to couple with the transport tube of the elongated housing, each vertical conduit having a rotary valve extending outwardly therefrom, each of the votary valves having a first position to allow coloring dye into the transport tube and a second position to prevent the coloring dye from entering into the transport tube.

* * * * *